United States Patent [19]

Sheahan et al.

[11] 4,099,672

[45] Jul. 11, 1978

[54] SHOWER-HEAD FIXTURE

[76] Inventors: Ray Albert Sheahan; Dorothy Marie Sheahan, both of 6160 S. 6th St. W26, Milwaukee, Wis.

[21] Appl. No.: 772,516

[22] Filed: Feb. 28, 1977

[51] Int. Cl.[2] ..... B05B 7/28

[52] U.S. Cl. ..... 239/317

[58] Field of Search ..... 239/310, 316, 317, 315

[56] References Cited

U.S. PATENT DOCUMENTS

| | | | |
|---|---|---|---|
| 2,058,901 | 10/1936 | McPherson | 239/310 X |
| 2,538,948 | 1/1951 | Richards | 239/317 |
| 2,602,697 | 7/1952 | Otto et al. | 239/310 X |
| 3,581,996 | 6/1971 | Boher | 239/317 |
| 3,628,732 | 12/1971 | Vicari | 239/310 |
| 3,720,352 | 3/1973 | Kozlowski | 239/310 |

FOREIGN PATENT DOCUMENTS

| | | | |
|---|---|---|---|
| 841,278 | 5/1970 | Canada | 239/310 |

*Primary Examiner*—Robert W. Saifer
*Attorney, Agent, or Firm*—Richard P. Ulrich

[57] ABSTRACT

A device for mixing various substances with shower water wherein water is supplied through an elbow device inserted in the water stream, mixed with the desired substance in an amount controlled by a valve, and returned to the shower water through an additional elbow device.

3 Claims, 1 Drawing Figure

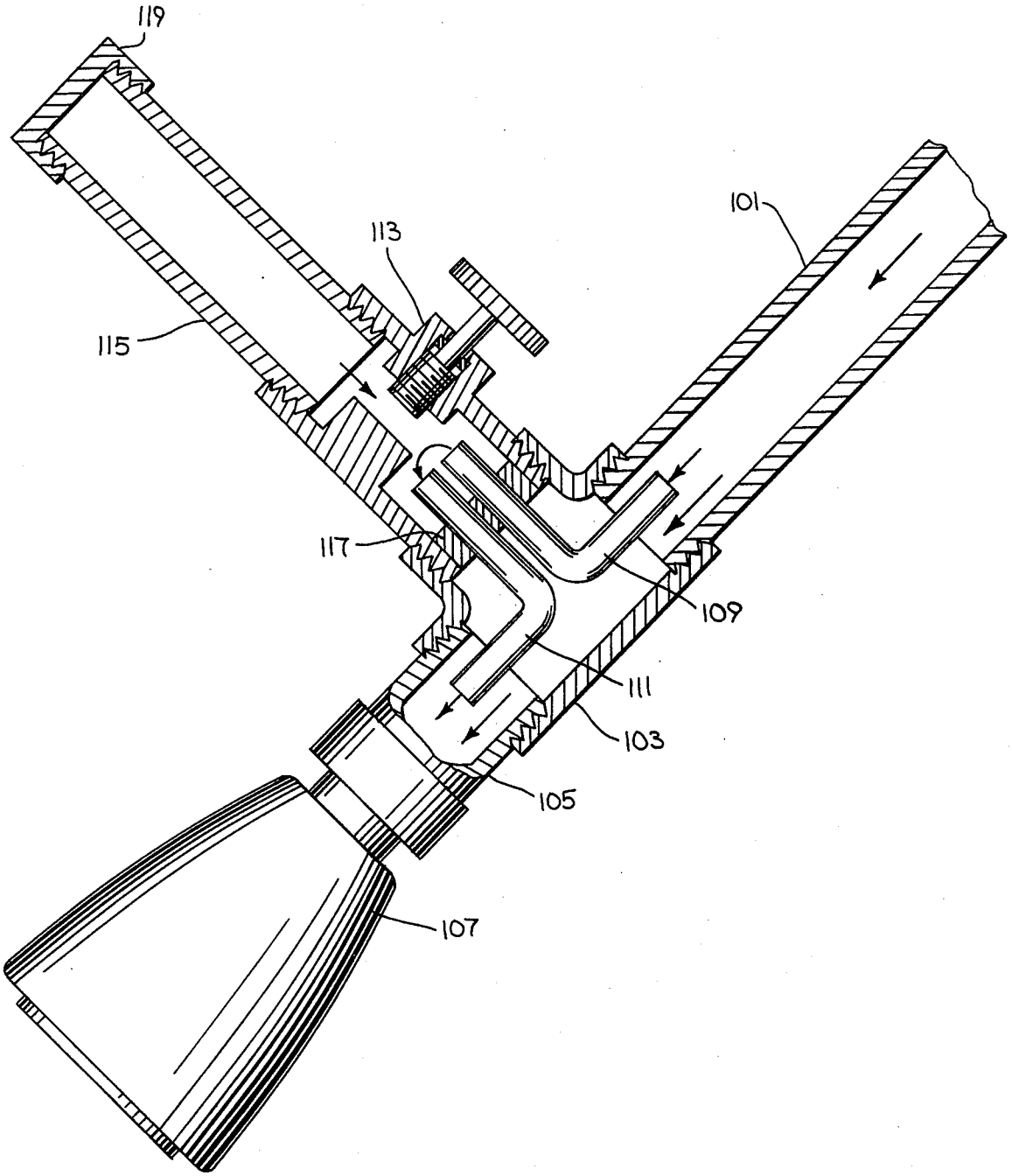
119
113
101
115
117
109
111
103
105
107

SHOWER-HEAD FIXTURE

SUMMARY OF INVENTION

This invention relates to means for mixing oil, soap and like substances either liquid or solid (hereinafter called oil) with water prior to its emission from a shower head.

There are a substantial number of mixing devices of which we are aware which provide means for mixing substances with water but none of these provide the simplicity of our novel device.

Furthermore, no device of which we are aware can be made using readily available components.

In addition, none of those devices of which we are aware use our unique combination of elements.

Therefore, it is an object of our invention to provide the means for mixing oil with water before emission from a shower head with a unique combination of readily available parts.

It is an additional object of our invention to provide means for mixing oil with water prior to emission from a shower head which is simpler of construction than any similar device of which we are aware.

DESCRIPTION OF THE DRAWING

FIGURE: A sectional view of the device.

DESCRIPTION OF THE PREFERRED EMBODIMENT

Referring to the FIGURE, inlet pipe 101 is connected to a first opening of "T" 103 while one end of nipple 105 is connected to a second opening "T" 103. The other end of nipple 105 is connected to shower head 107.

"Elbow" tube 109, which may be made of plastic, is placed within "T" 103 so that one end of tube 109 is contained within the first opening of "T" 103 and the other end of tube 109 is contained within a third opening of "T" 103.

"Elbow" tube 111 which also may be made of plastic, is placed within "T" 103 so that one end of tube 111 is contained within the second opening of "T" 103 and the other end of tube 111 is contained within the third opening of "T" 103.

A first end of valve 113 is attached to "T" 103 at its third opening. A second end of valve 113 is attached to oil container 115. Tubes 109 and 111 may be held in place by two hole plug 117 which is inserted in the first end of valve 113. In addition plug 117 provides a seal around the tubes so that intake water must flow through tube 109 and the mixture must flow through tube 111. Oil container 115 may be sealed with cap 119.

Operation of the invention is as follows:

When the shower is turned on water travels in the direction of the arrows through pipe 101. Some of the water traveling through pipe 101 is forced into and through tube 109. The remainder by-passes the tube and emerges from the shower head without mixing with the oil. Valve 113 controls the amount of oil which is mixed with the water. The mixture is returned to the main stream through tube 111. The wider valve 113 is opened the richer is the mixture emerging from the shower head.

The container may be filled by removing cap 119 and placing oil in container 115.

What is claimed is:

1. An oil-water mixing device for use in a shower comprising:

a. an oil container for holding an oil supply;

b. first elbow means for directing a portion of supply water into the container from a supply pipe, thereby mixing the oil and the water;

c. second elbow means for returning the mixture from the container to the water stream; and d. valve means between the first and second elbow means and the container for controlling the amount of oil to be mixed with the water.

2. The device as claimed in claim 1 which further comprises two-hole plug means which is inserted in a first end of the valve means, and holds the elbow means in place.

3. The device as claimed in claim 2 wherein the elbow means are plastic "L" shaped tubes.

* * * * *